US009617632B2

(12) United States Patent
Collins et al.

(10) Patent No.: US 9,617,632 B2
(45) Date of Patent: Apr. 11, 2017

(54) CONCURRENT FLOW OF ACTIVATING GAS IN LOW TEMPERATURE CARBURIZATION

(71) Applicant: Swagelok Company, Solon, OH (US)

(72) Inventors: Sunniva R. Collins, Cleveland Heights, OH (US); Gerhard H. Schiroky, Aurora, OH (US); Steven V. Marx, University Heights, OH (US); Peter C. Williams, Cleveland Heights, OH (US)

(73) Assignee: Swagelok Company, Solon, OH (US)

( * ) Notice: Subject to any disclaimer, the term of this patent is extended or adjusted under 35 U.S.C. 154(b) by 541 days.

(21) Appl. No.: 13/733,939

(22) Filed: Jan. 4, 2013

(65) Prior Publication Data

US 2013/0186520 A1 Jul. 25, 2013

Related U.S. Application Data

(60) Provisional application No. 61/588,728, filed on Jan. 20, 2012.

(51) Int. Cl.

| | |
|---|---|
| ***C23C 8/22*** | (2006.01) |
| ***C21D 6/00*** | (2006.01) |
| ***C21D 1/74*** | (2006.01) |
| ***C21D 1/773*** | (2006.01) |
| ***C21D 1/06*** | (2006.01) |

(52) U.S. Cl.

CPC ..... *C23C 8/22* (2013.01); *C21D 1/06* (2013.01); *C21D 1/74* (2013.01); *C21D 1/773* (2013.01); *C21D 6/00* (2013.01); *C21D 6/001* (2013.01); *C21D 6/002* (2013.01); *C21D 6/004* (2013.01)

(58) Field of Classification Search

CPC .... C23C 8/22; C23C 8/20; C21D 1/06; C21D 1/74; C21D 6/00

USPC ..... 148/223

See application file for complete search history.

(56) References Cited

U.S. PATENT DOCUMENTS

| | | | |
|---|---|---|---|
| 3,796,615 | A | 3/1974 | Westeren et al. |
| RE29,881 | E | 1/1979 | Westeren et al. |
| 4,160,680 | A | 7/1979 | Novy et al. |
| 4,166,610 | A | 9/1979 | Yamazaki et al. |
| 4,168,186 | A | 9/1979 | Limque et al. |
| 4,191,598 | A | 3/1980 | Conybear et al. |
| 4,386,973 | A | 6/1983 | Kawka et al. |
| 4,455,177 | A | 6/1984 | Filippov et al. |
| 4,710,238 | A | 12/1987 | Dawes et al. |
| 4,773,947 | A | 9/1988 | Shibata et al. |
| 4,807,853 | A | 2/1989 | Murakami et al. |
| 4,836,864 | A | 6/1989 | Murakami et al. |
| 5,205,873 | A | 4/1993 | Faure et al. |
| 5,252,145 | A | 10/1993 | Tahara et al. |
| 5,344,502 | A | 9/1994 | Mack et al. |
| 5,376,188 | A | 12/1994 | Tahara et al. |
| 5,556,483 | A | 9/1996 | Tahara et al. |
| 5,593,510 | A | 1/1997 | Tahara et al. |
| 5,702,540 | A | 12/1997 | Kubota |
| 5,792,282 | A | 8/1998 | Tahara et al. |
| 5,988,165 | A | 11/1999 | Richey, II et al. |
| 6,093,303 | A | 7/2000 | Williams et al. |
| 6,101,719 | A | 8/2000 | Kiuchi et al. |
| 6,165,597 | A | 12/2000 | Williams et al. |
| 6,187,111 | B1 | 2/2001 | Waka et al. |
| 6,258,179 | B1 | 7/2001 | Takayama et al. |
| 6,309,474 | B1 | 10/2001 | Yagasaki |
| 6,309,475 | B1 | 10/2001 | Takayama et al. |
| 6,547,888 | B1 * | 4/2003 | Williams et al. ..... 148/206 |
| 6,776,854 | B2 | 8/2004 | Bardeimeier et al. |
| 6,814,573 | B2 | 11/2004 | Hiramoto |
| 6,846,366 | B2 | 1/2005 | Kawata et al. |
| 6,923,180 | B2 | 8/2005 | Richey, II et al. |
| 6,991,687 | B2 | 1/2006 | Poor et al. |
| 7,024,916 | B2 | 4/2006 | Juryozawa et al. |
| 7,029,625 | B2 | 4/2006 | Shimosato et al. |
| 7,033,446 | B2 | 4/2006 | Poor et al. |
| 7,108,756 | B2 | 9/2006 | Lippmann et al. |
| 7,112,248 | B2 | 9/2006 | Yamaguchi |
| 7,118,634 | B2 | 10/2006 | Goldsteinas et al. |
| 7,122,086 | B2 * | 10/2006 | Tanaka et al. ..... 148/223 |
| 7,186,304 | B2 | 3/2007 | Chin et al. |
| 7,208,052 | B2 | 4/2007 | Hammond et al. |
| 7,276,204 | B2 | 10/2007 | Ebihara et al. |
| 7,357,843 | B2 | 4/2008 | Yamaguchi et al. |

(Continued)

FOREIGN PATENT DOCUMENTS

| | | |
|---|---|---|
| BG | 51115 | 2/1993 |
| CH | 641840 | 3/1984 |

(Continued)

OTHER PUBLICATIONS

International Search Report and Written Opinion from PCT/US10/44510 dated Sep. 23, 2010.
Office action from U.S. Appl. No. 12/850,925 dated Nov. 29, 2012.
Response from U.S. Appl. No. 12/850,925 daetd Jan. 7, 2013.
Office action from U.S. Appl. No. 12/850,925 dated Feb. 8, 2013.
Response from U.S. Appl. No. 12/850,925 dated Jun. 10, 2013.
Office action from U.S. Appl. No. 12/850,925 dated Jun. 21, 2013.
El-Rahman et al., "Effect of N2 to C2H2 ratio on r.f. plasma surface treatment of austenitic stainless steel", Surface and Coatings Technology, 183, (2004), 268-274.
Michal, et al., "Surface Hardening of Austenitic Steels by Low Temperature Colossal Supersaturation", Materials Science & Technology MS&T Conference Proceedings 2004 Journal, pp. 347-353.
International Search Report and Written Opinion from PCT/US13/20196 dated Mar. 19, 2013.
Stickels, C.A. "Gas Carburizing", ASM Handbook, vol. 4, Heat Treating, pp. 312-324, 1991.

(Continued)

*Primary Examiner* — Jessee Roe
*Assistant Examiner* — Jenny Wu
(74) *Attorney, Agent, or Firm* — Calfee, Halter & Griswold LLP

(57) ABSTRACT

Low temperature gas carburization of stainless steel using acetylene as the carburizing specie is carried out under soft vacuum conditions in the presence of hydrogen or other companion gas. Carburization is made to go faster by including HCl or other carbon-free, halogen-containing activating compound in the carburizing gas being fed to the carburization reactor.

13 Claims, No Drawings

(56) References Cited

U.S. PATENT DOCUMENTS

| | | | | |
|---|---|---|---|---|
| 7,513,958 | B2 | 4/2009 | Kula et al. | |
| 7,524,382 | B2 | 4/2009 | Fink | |
| 7,550,049 | B2 | 6/2009 | Kula et al. | |
| 7,575,643 | B2 | 8/2009 | Ebihara et al. | |
| 7,722,801 | B2 | 5/2010 | Sato | |
| 7,794,551 | B1 | 9/2010 | Imbrogno et al. | |
| 7,811,390 | B2 | 10/2010 | Ishii et al. | |
| 7,967,920 | B2 | 6/2011 | Kula et al. | |
| 7,998,282 | B2 | 8/2011 | Taniguchi et al. | |
| 2002/0166607 | A1 | 11/2002 | Altena et al. | |
| 2003/0020214 | A1 | 1/2003 | Poor et al. | |
| 2005/0016831 | A1 | 1/2005 | Paganessi et al. | |
| 2005/0247375 | A1 | 11/2005 | Suzuki et al. | |
| 2006/0090817 | A1 | 5/2006 | Somers et al. | |
| 2006/0102253 | A1 | 5/2006 | Berglund | |
| 2006/0108719 | A1 | 5/2006 | Jurmann et al. | |
| 2006/0124203 | A1 | 6/2006 | Ishida et al. | |
| 2006/0130935 | A1 | 6/2006 | Hattori et al. | |
| 2006/0137766 | A1 | 6/2006 | Kozawa et al. | |
| 2007/0044866 | A1 | 3/2007 | Morita et al. | |
| 2007/0062612 | A1 | 3/2007 | Katsumata | |
| 2007/0068601 | A1 | 3/2007 | Jones et al. | |
| 2007/0102068 | A1 | 5/2007 | Taniguchi et al. | |
| 2007/0204934 | A1 | 9/2007 | Hoshino et al. | |
| 2007/0246126 | A1 | 10/2007 | Hattori et al. | |
| 2008/0006346 | A1 | 1/2008 | Sato | |
| 2008/0073001 | A1 | 3/2008 | Katsumata | |
| 2008/0073002 | A1 | 3/2008 | Abukawa et al. | |
| 2008/0076001 | A1 | 3/2008 | Uchiyama et al. | |
| 2008/0149225 | A1 | 6/2008 | Connery et al. | |
| 2008/0156399 | A1 | 7/2008 | Machida et al. | |
| 2008/0216922 | A1 | 9/2008 | Katsumata | |
| 2008/0247901 | A1 | 10/2008 | Morita et al. | |
| 2009/0084470 | A1 | 4/2009 | Kato et al. | |
| 2009/0178733 | A1* | 7/2009 | Somers et al. | 148/235 |
| 2009/0197112 | A1 | 8/2009 | Fink et al. | |
| 2009/0266449 | A1 | 10/2009 | Ohbayashi et al. | |
| 2009/0308497 | A1 | 12/2009 | Jo et al. | |
| 2009/0320962 | A1 | 12/2009 | Nakai et al. | |
| 2010/0037991 | A1* | 2/2010 | Collins et al. | 148/218 |
| 2010/0043582 | A1 | 2/2010 | Tateishi et al. | |
| 2010/0084051 | A1 | 4/2010 | Mizuno et al. | |
| 2010/0276036 | A1 | 11/2010 | Hazel et al. | |
| 2011/0017350 | A1 | 1/2011 | Hammond et al. | |
| 2011/0030849 | A1 | 2/2011 | Williams et al. | |
| 2011/0036462 | A1 | 2/2011 | Berlier et al. | |
| 2011/0067784 | A1 | 3/2011 | Grafen et al. | |
| 2011/0108164 | A1 | 5/2011 | Jain et al. | |
| 2011/0129382 | A1 | 6/2011 | Jo et al. | |
| 2011/0171404 | A1* | 7/2011 | Baker | B27N 3/02 428/35.6 |
| 2011/0206473 | A1 | 8/2011 | Thompson et al. | |
| 2011/0277887 | A1 | 11/2011 | Foerster et al. | |
| 2013/0299047 | A1* | 11/2013 | Fabijanic | 148/230 |

FOREIGN PATENT DOCUMENTS

| | | |
|---|---|---|
| DE | 3110488 | 9/1982 |
| DE | 3217295 | 12/1982 |
| DE | 4236801 | 5/1994 |
| DE | 10254846 | 6/2004 |
| DE | 10322563 | 11/2004 |
| DE | 10322255 | 12/2004 |
| DE | 102004009288 | 9/2005 |
| DE | 102005058903 | 7/2006 |
| DE | 102005061946 | 8/2006 |
| DE | 102008053310 | 4/2010 |
| DE | 112008001105 | 6/2010 |
| DE | 102010003902 | 6/2011 |
| EP | 147845 | 7/1985 |
| EP | 242089 | 10/1987 |
| EP | 465333 | 1/1992 |
| EP | 532386 | 3/1993 |
| EP | 787817 | 8/1997 |
| EP | 947600 | 10/1999 |
| EP | 960951 | 12/1999 |
| EP | 1080243 | 3/2001 |
| EP | 818555 | 7/2001 |
| EP | 1162279 | 12/2001 |
| EP | 1193413 | 4/2002 |
| EP | 1247875 | 10/2002 |
| EP | 1306462 | 5/2003 |
| EP | 1432841 | 6/2004 |
| EP | 1482060 | 12/2004 |
| EP | 1544317 | 6/2005 |
| EP | 1550736 | 7/2005 |
| EP | 1642995 | 4/2006 |
| EP | 1558781 | 10/2006 |
| EP | 1757711 | 2/2007 |
| EP | 1847630 | 10/2007 |
| EP | 1847631 | 10/2007 |
| EP | 1885904 | 2/2008 |
| EP | 1889929 | 2/2008 |
| EP | 1905862 | 4/2008 |
| EP | 1980630 | 10/2008 |
| EP | 2128301 | 12/2009 |
| EP | 2133435 | 12/2009 |
| EP | 2284286 | 2/2011 |
| EP | 2284287 | 2/2011 |
| EP | 2322687 | 5/2011 |
| FR | 2792339 | 10/2000 |
| FR | 2827875 | 1/2003 |
| FR | 2832735 | 5/2003 |
| FR | 2909100 | 5/2008 |
| GB | 785878 | 11/1957 |
| GB | 852108 | 10/1960 |
| GB | 1066134 | 4/1967 |
| GB | 2333782 | 8/1999 |
| JP | H08158035 | 6/1996 |
| JP | 9-071853 | 3/1997 |
| JP | 9-268364 | 10/1997 |
| JP | 2753647 | 3/1998 |
| JP | 2963869 | 8/1999 |
| JP | 3046293 | 3/2000 |
| JP | 3100342 | 8/2000 |
| JP | 2000-336469 | 12/2000 |
| JP | 3302967 | 4/2002 |
| JP | 3303741 | 5/2002 |
| JP | 3310797 | 5/2002 |
| JP | 2002-363726 | 12/2002 |
| JP | 2003-119558 | 4/2003 |
| JP | 2003-171756 | 6/2003 |
| JP | 3442447 | 6/2003 |
| JP | 3442737 | 6/2003 |
| JP | 3445968 | 6/2003 |
| JP | 3559048 | 5/2004 |
| JP | 2004-332074 | 11/2004 |
| JP | 2004-332075 | 11/2004 |
| JP | 2005-036279 | 2/2005 |
| JP | 2005036278 A * | 2/2005 |
| JP | 3661868 | 4/2005 |
| JP | 2005-200674 | 7/2005 |
| JP | 2005-325371 | 11/2005 |
| JP | 2006-183095 | 7/2006 |
| JP | 3839615 | 8/2006 |
| JP | 3852010 | 9/2006 |
| JP | 3854851 | 9/2006 |
| JP | 2006-322036 | 11/2006 |
| JP | 3931276 | 3/2007 |
| JP | 3996482 | 8/2007 |
| JP | 2007-308792 | 11/2007 |
| JP | 4041602 | 11/2007 |
| JP | 4050512 | 12/2007 |
| JP | 4254816 | 2/2009 |
| JP | 4255815 | 2/2009 |
| JP | 2009-057597 | 3/2009 |
| JP | 2008-163304 | 4/2009 |
| JP | 2009-084607 | 4/2009 |
| JP | 4292280 | 4/2009 |
| JP | 2009-114488 | 5/2009 |
| JP | 4310776 | 5/2009 |
| JP | 2009-138207 | 6/2009 |
| JP | 4322093 | 6/2009 |

(56) References Cited

FOREIGN PATENT DOCUMENTS

| | | |
|---|---|---|
| JP | 4350968 | 7/2009 |
| JP | 4354277 | 8/2009 |
| JP | 4381381 | 10/2009 |
| JP | 2010-007117 | 1/2010 |
| JP | 4458079 | 2/2010 |
| JP | 2008-069436 | 3/2010 |
| JP | 2010-053431 | 3/2010 |
| JP | 4092074 | 3/2010 |
| JP | 2010-090437 | 4/2010 |
| JP | 4518604 | 5/2010 |
| JP | 4164995 | 8/2010 |
| JP | 4169864 | 8/2010 |
| JP | 2008-208403 | 9/2010 |
| JP | 4188307 | 9/2010 |
| JP | 2008-538386 | 10/2010 |
| JP | 2010-222636 | 10/2010 |
| JP | 4605718 | 10/2010 |
| JP | 2008-280610 | 11/2010 |
| JP | 4627776 | 11/2010 |
| JP | 4629064 | 11/2010 |
| JP | 2011-017040 | 1/2011 |
| JP | 4655528 | 1/2011 |
| JP | 2011-149061 | 8/2011 |
| JP | 2011-157598 | 8/2011 |
| JP | 2011-190513 | 9/2011 |
| JP | 4876668 | 12/2011 |
| KR | 1002771560000 | 10/2000 |
| KR | 1007072200000 | 4/2007 |
| WO | 03/048405 | 6/2003 |
| WO | 03/050321 | 6/2003 |
| WO | 03/097893 | 11/2003 |
| WO | 2004/007789 | 1/2004 |
| WO | 2004/031432 | 4/2004 |
| WO | 2004/035853 | 4/2004 |
| WO | 2005/038076 | 4/2005 |
| WO | 2005/118904 | 12/2005 |
| WO | 2006/009720 | 1/2006 |
| WO | 2006/136166 | 12/2006 |
| WO | 2007/034911 | 3/2007 |
| WO | 2007/039468 | 4/2007 |
| WO | 2007/110905 | 10/2007 |
| WO | WO 2008124238 A2 * | 10/2008 |
| WO | 2009/082180 | 7/2009 |
| WO | 2009/119529 | 10/2009 |
| WO | 2009/131202 | 10/2009 |
| WO | 2010/138369 | 12/2010 |
| WO | 2011/009463 | 1/2011 |
| WO | 2011/013559 | 2/2011 |
| WO | 2011/017495 | 2/2011 |
| WO | 2011/029565 | 3/2011 |
| ZA | WO 2005097444 A1 * | 10/2005 ..... B27N 3/02 |

OTHER PUBLICATIONS

Response from U.S. Appl. No. 12/850,925 dated Aug. 22, 2013.
Advisory Action from U.S. Appl. No. 12/850,925 dated Aug. 29, 2013.
Office action from U.S. Appl. No. 12/850,925 dated Sep. 17, 2014.
Response from U.S. Appl. No. 12/850,925 dated Dec. 11, 2014.
Notice of Allowance from U.S. Appl. No. 12/850,925 dated Jan. 2, 2015.
Office action from Australian Application No. 2010279452 dated Oct. 3, 2014.
Office action from Japanese Application No. 2012-523940 dated May 13, 2014.
Office action from Chinese Application No. 201080035086.1 dated Oct. 10, 2014.
Office action from European Application No. 13739132.2 dated Nov. 6, 2015.
Notice of Allowance from U.S. Appl. No. 12/850,925 dated Aug. 12, 2015.
Office action from Canadian Application No. 2,771,090 dated Jun. 1, 2016.
Office action from European Application No. 10807141.6 dated Jun. 10, 2016.
Office action from Korean Application No. 10-2012-7005956 dated May 23, 2016.
Office action from Chinese Application No. 201080035086.1 dated Jun. 9, 2015.
Office action from Japanese Application No. 2014-553312 dated Nov. 16, 2016.

* cited by examiner

CONCURRENT FLOW OF ACTIVATING GAS IN LOW TEMPERATURE CARBURIZATION

RELATED APPLICATION

This application claims priority and all other benefits of U.S. Provisional Application Ser. No. 61/588,728 which is hereby incorporated by reference in its entirety.

BACKGROUND

Conventional Gas Carburization

Traditional (high temperature) carburization is a widely used industrial process for enhancing the surface hardness of shaped metal articles ("case hardening"). In a typical commercial process, the workpiece is contacted with a carbon containing gas at elevated temperature whereby carbon atoms liberated by decomposition of the gas diffuse into the workpiece's surface. Hardening occurs through the reaction of these diffused carbon atoms with one or more metals in the workpiece thereby forming distinct chemical compounds, i.e., carbides, followed by precipitation of these carbides as discrete, extremely hard, crystalline particles in the metal matrix forming the workpiece's surface. See, Stickels, "Gas Carburizing", pp 312 to 324, Volume 4, *ASM Handbook,* © 1991, ASM International.

In the last few years, new methods have been introduced for carrying out traditional carburization in which acetylene supplied at very low pressures is used as the carburizing gas. A primary benefit claimed for this approach is that the amount of by-product soot that is formed as part of the carburization reaction is reduced. See, EP 818 555 and corresponding U.S. Pat. No. 5,702,540. In some instances, acetylene flow to the reaction chamber is pulsed rather than constant, as this is said to reduce soot formation even further.

Stainless steel is corrosion-resistant because of the coherent, impervious layer of chromium oxide which inherently forms on the surface of the steel as soon as it is exposed to the atmosphere. When stainless steel is traditionally carburized, the chromium content of the steel is depleted through the formation of the carbide precipitates responsible for surface hardening. As a result, there is insufficient chromium in the steel, at least in areas immediately surrounding the chromium carbide precipitates, to form this chromium oxide protective coating. For this reason, stainless steel is rarely case hardened by conventional carburization, since the corrosion resistance of the steel is compromised.

In the mid 1980's, a technique for case hardening stainless steel was developed in which the workpiece is contacted with a carbon containing gas at low temperature, typically below ~550° C. (~1000° F.). At these temperatures, and provided that carburization does not last too long, carbon atoms liberated by decomposition of the gas diffuse into the workpiece surfaces, typically to a depth of 20-50μ, without formation of carbide precipitates. Nonetheless, an extraordinarily hard case (surface layer) is obtained. Because carbide precipitates are not produced, the corrosion resistance of the steel is unimpaired, even improved. This technique, which is referred to as "low temperature carburization," is described in a number of publications including U.S. Pat. No. 5,556,483, U.S. Pat. No. 5,593,510, U.S. Pat. No. 5,792,282, U.S. Pat. No. 6,165,597, U.S. Pat. No. 6,547,888, EPO 0787817, Japan 9-14019 (Kokai 9-268364) and Japan 9-71853 (Kokai 9-71853).

Original thinking was that surface hardening occurs in low temperature carburization due solely to the stress placed on the crystal lattice of the metal by the carbon atoms which have diffused into this lattice. However, recent analytical work suggests that an additional phase or phases may be formed in this hardened surface layer. While the exact nature of these additional phases is still unknown, what is known is that the chromium content of these additional phases is identical to that of the surrounding metal matrix. The result is that the corrosion resistance of the steel remains unimpaired, because the chromium responsible for corrosion resistance remains uniformly distributed throughout the metal.

Acetylene

U.S. Pat. No. 7,122,086 to Tanaka et al., the entire disclosure of which is also incorporated herein by reference, describes a low temperature gas carburization process in which a stainless steel workpiece is carburized by contact with acetylene in a hard vacuum, i.e., at a total pressures of 1 torr (133 Pa (Pascals)) or less. A primary benefit claimed for this approach is that the production of soot and undesirable thermal oxide film byproducts is substantially reduced. Nonetheless, the carburized workpiece obtained still needs to be treated, mechanically and/or chemically, to remove these byproduct layers before a usable, final product is obtained.

WO 2006/136166 (U.S. 2009/0178733) to Marcel Somers et al., the entire disclosure of which is also incorporated herein by reference, describes a similar low temperature gas carburization process in which acetylene is used as the carbon source for the carburization of stainless steel workpieces. Both atmospheric and subatmospheric pressures are disclosed. If desired, hydrogen ($H_2$) can be included in the carburizing gas to facilitate decomposition of the acetylene and make control of the process easier.

Activation

As indicated above, stainless steel is corrosion-resistant because of the coherent, impervious layer of chromium oxide which inherently forms on the surface of the steel as soon as it is exposed to the atmosphere. Because the temperatures involved in low temperature carburization are so low, carbon atoms will not penetrate this chromium oxide protective coating. Therefore, low temperature carburization of stainless steel is nominally preceded by an activation step in which the workpiece is contacted with a halogen containing activating compound such as HF, HCl, $NF_3$, $F_2$ or $Cl_2$ at elevated temperature, e.g., 200 to 400° C., to make the steel's protective oxide coating permeable to carbon atoms. See, the above-noted U.S. Pat. No. 5,556,483, U.S. Pat. No. 5,593,510, U.S. Pat. No. 5,792,282, U.S. Pat. No. 6,165,597, U.S. Pat. No. 6,547,888, EPO 0787817, Japan 9-14019 (Kokai 9-268364), Japan 9-71853 (Kokai 9-71853), and U.S. Pat. No. 7,122,086 to Tanaka et al.

See, also, the above-noted WO 2006/136166 (U.S. 2009/0178733) to Marcel Somers et al., which indicates that such a separate activation step is unnecessary if acetylene is used as the carburizing gas, as decomposition of the acetylene for carburization also activates the chromium oxide coating. In practice, however, activation this way is unsuitable for commercial operations, because carburization is too slow, the results obtained too uneven, or both.

Clean UP

Low temperature gas carburization normally produces soot as an unwanted by-product. In addition, low temperature carburization also produces an undesirable, porous "thermal" oxide film on the outermost surfaces of the workpiece about 20-30 nm thick. See, Japan 9-71853 (Kokai 9-71853). In addition, under this thermal oxide film, an extremely thin outer surface layer of the metal may contain a small amount of carbide precipitates, especially if the low temperature carburization conditions are too severe. See, U.S. Pat. No. 5,556,483, U.S. Pat. No. 5,593,510 and U.S. Pat. No. 5,792,282. In order for the workpiece to exhibit an attractive shiny, metallic appearance, this soot and outermost thermal oxide film must be removed. Therefore, as a practical matter, these undesirable surface layers (i.e., the soot, thermal oxide film, and thin outermost metal layer containing carbide precipitates, if any) are removed before the workpiece is used. Normally, only a minimal amount of the workpiece's metal surface is removed, about 1 micron or so, since the hardened "case" produced by low temperature carburization only extends down to the first 10-25 microns or so of the workpiece's surface.

In any event, in the context of this disclosure, reference to a workpiece surface layer which is "essentially free of carbide precipitates" or which is made "without formation of carbide precipitates" refers to the corrosion-resistant, carbon-hardened surface layer underneath these unwanted byproduct layers. For convenience, this corrosion-resistant, hardened byproduct-free surface layer is referred to herein as the "primary" surface layer of the workpiece.

In our earlier published application U.S. 2011/0030849, the disclosure of which is also incorporated herein by reference in its entirety, we describe a process for the low temperature gas carburization of stainless steel which is carried out without formation of the above-noted soot and thermal oxide film. This is done by carrying out the carburization reaction in a soft vacuum, i.e., a total reaction pressure of about 3.5 to 100 torr (~500 to ~13,000 Pa), using acetylene or analog as the carburizing gas. Separate activation by contact with a halogen containing gas is still required, as a practical matter, for the reasons indicated above, i.e., because carburization is too slow, or the results obtained too uneven, if activation occurs solely through decomposition of the acetylene.

SUMMARY

In accordance with this invention, we have found that low temperature gas carburization of stainless steel in a soft vacuum using acetylene or analog as the carbon source can be accomplished faster than previously possible if a carbon-free, halogen-containing activating compound is included in the gas mixture inside the carburization reactor during the carburization reaction.

Thus, this invention provides a process for surface hardening a workpiece made from an iron, nickel and/or chromium based alloy by gas carburization in which an unsaturated hydrocarbon is contacted with the workpiece inside a carburization reactor under a soft vacuum and at an elevated carburization temperature to cause carbon to diffuse into the workpiece surfaces thereby forming a hardened primary surface layer essentially free of carbide precipitates, the process further comprising feeding a carbon-free, halogen-containing activating compound to the carburization reactor simultaneously with feeding the unsaturated hydrocarbon to the carburization reactor.

In a preferred embodiment, the concentration of this carbon-free, halogen-containing activating compound in the carburizing gas is kept low enough, typically ~10 vol. % or less, and the time during which this carbon-free, halogen-containing activating compound is included in the carburizing gas is kept short enough, typically ~40 minutes or less, so that formation of byproduct soot and/or thermal oxide is essentially avoided. As a result, a surface-hardened, corrosion-resistant stainless steel workpiece exhibiting a shiny metallic appearance can be produced without the post-carburization cleaning step required in most prior art processes for removing the byproduct soot and/or thermal oxide that forms on the workpiece surfaces.

Accordingly, this invention also provides a process for producing a surface-hardened, corrosion-resistant stainless steel workpiece exhibiting a shiny metallic appearance without requiring removal of byproduct soot or thermal oxide from the workpiece surfaces, this process comprising contacting the workpiece with an unsaturated hydrocarbon inside a carburization reactor under a soft vacuum under conditions of time and temperature which are sufficient to cause carbon to diffuse into the workpiece surfaces thereby forming a hardened primary surface layer essentially free of carbide precipitates but insufficient to cause byproduct soot or thermal oxide to form to any significant degree, wherein the process further comprises feeding a carbon-free, halogen-containing activating compound to the carburization reactor simultaneously with feeding the unsaturated hydrocarbon to the carburization reactor, wherein the amount of carbon-free, halogen-containing activating compound fed to the carburization reactor is kept low enough and the length of time the carbon-free, halogen-containing activating compound is fed to the carburization reactor is kept short enough so that formation of byproduct soot or thermal oxide or both is essentially avoided.

DETAILED DESCRIPTION

Alloys

While this invention will normally be carried out on stainless steels, it can also be used on workpieces made from other iron, nickel, cobalt and/or chromium-based alloys. Such materials are well known and described for example in the above-noted U.S. Pat. No. 5,792,282, U.S. Pat. No. 6,093,303, U.S. Pat. No. 6,547,888, EPO 0787817 and Japanese Patent Document 9-14019 (Kokai 9-268364).

Particular alloys of interest are steels, especially steels containing 5 to 50, preferably 10 to 40, wt. % Ni. Preferred alloys contain 10 to 40 wt. % Ni and 10 to 35 wt. % Cr. More preferred are the stainless steels, especially the AISI 300 series steels. Of special interest are AISI 301, 303, 304, 309, 310, 316, 316L, 317, 317L, 321, 347, CF8M, CF3M, 254SMO, A286 and AL6XN stainless steels. The AISI 400 series stainless steels and especially Alloy 410, Alloy 416 and Alloy 440C are also of special interest.

Particular nickel-based alloys which can be low temperature carburized in accordance with this invention include Alloy 600, Alloy 625, Alloy 825, Alloy C-22, Alloy C-276, Alloy 20 Cb and Alloy 718, to name a few examples.

In addition to iron- and nickel-based alloys, low temperature carburization in accordance with the present invention can also be practiced on cobalt-based alloys as well as manganese-based alloys. Examples of such cobalt-based alloys include MP35N and Biodur CMM, while examples of such manganese-based alloys include AISI 201, AISI 203EZ and Biodur 108.

Low temperature carburization in accordance with the present invention can also be practiced on various duplex steels including Alloy 2205, Alloy 2507, Alloy 2101 and Alloy 2003, for example, as well as on various age hardenable alloys such as Alloy 13-8, Alloy 15-5 and Alloy 17-4, for example. The particular phase of the metal being processed in accordance with the present invention is unimportant, as the invention can be practiced on metals of any phase structure including, but not limited to, austenite, ferrite, martensite, duplex metals (e.g., austenite/ferrite), etc.

Activation

As indicated above, before stainless steel can be low temperature carburized, it is treated to render its coherent chromium oxide protective coating transparent to carbon atoms, usually by contact with a halogen containing activating compound such as HF, HCl, $NF_3$, $F_2$ or $Cl_2$. Even though these same compounds are included in the gas mixture inside the carburization reactor of this invention for speeding carburization, it is still desirable to subject the workpiece being carburized to such a preliminary activation treatment to speed the overall carburization process.

While this can be done by any known activation technique, this is most conveniently done by the same activation technique mentioned above, i.e., by contact of the workpiece with a halogen containing activating compound such as HF, HCl, $NF_3$, $F_2$ or $Cl_2$ in a suitable carrier gas at elevated temperature. Most conveniently, activation is done in the same reactor as carburization without removing the workpiece from the reactor or otherwise exposing the workpiece to the atmosphere between activation and carburization, since this allows the less expensive and easier to handle chlorine based compounds such as HCl to be used.

Carburization Temperature

Conventional low temperature carburization is normally carried out at reaction temperatures below 550° C., normally about 450° C. to 525° C. In contrast, modified low temperature carburization processes in which acetylene or analogue is used as the carbon source are normally carried out at lower temperatures, typically on the order of 350° C. to 510° C., but more commonly 350° C. to 450° C., because unsaturated hydrocarbons are so active.

Any of these carburization temperatures can be used in the inventive process, if desired. However, the lower carburization temperatures described above, 350° C. to 510° C., more commonly 350° C. to 450° C., will normally be employed because they allow better control of the carburization reaction and result in less soot production.

Vacuum Carburization Conditions

In our earlier U.S. 2011/0030849, we indicate that when carburizing under a soft vacuum using acetylene or other unsaturated hydrocarbon as the carburizing specie, it is desirable to maintain the total system pressure inside the reactor at about 3.5 to 100 torr (~500 to ~13,000 Pa), as this combination of features can eliminate formation of by-product soot and thermal oxide film virtually completely. The same applies to this invention as well.

Accordingly, the inventive low temperature gas carburization process will normally be carried out under a total system pressure of about 3.5 to 100 torr (~500 to ~13,000 Pa). In this context, "total system pressure" will be understood to mean the pressure of the entire gas mixture inside the carburization reactor during the inventive carburization process, i.e., the unsaturated hydrocarbon carburizing specie of this invention, the carbon-free halogen-containing activating compound of this invention, the companion gas discussed below, if any, and any other optional gas that may be included in this gas system. Total system pressures on the order of 4 to 75 torr (~533 to ~10,000 Pa), 4.5 to 50 torr (~600 to ~6,666 Pa), 5 to 25 torr (~666 to ~3,333 Pa), 5.5 to 15 torr (~733 to ~2,000 Pa), and even 6 to 9 torr (~80 to ~1,200 Pa), are desirable.

Concurrent Supply of Activating and Carburizing Gases

Conventionally, low temperature gas carburization is done by placing the workpiece in a carburization reactor, optionally evacuating the reactor to the desired level of vacuum, and then continuously feeding a carburizing gas to the reactor during the carburization reaction at a suitable flowrate and temperature while maintaining the desired level of vacuum in the reactor. The gas mixture the workpiece actually contacts inside the carburization reactor is controlled by controlling the concentration of ingredients in the carburizing gas being fed to the reactor, the flowrate of this carburizing gas and the level of vacuum inside the reactor. Activation of the workpiece is typically done in the same way, i.e., by feeding to the reactor an activating compound such as HF, HCl, $NF_3$, $F_2$ or $Cl_2$ in a suitable carrier gas at a suitable flowrate and temperature while maintaining the desired level of vacuum in the reactor.

As further described in our earlier U.S. Pat. No. 6,547,888 and published application U.S. 2011/0030849 mentioned above, activation and carburization in low temperature gas carburization are normally done in the same reactor, without removing the workpiece from the reactor or otherwise exposing the workpiece to the atmosphere. This means that, in this conventional practice, the carbon-containing compound used for carburizing ("carburizing specie") and the halogen-containing activating compound used for activation are fed to this carburization reactor separately and sequentially.

Because the internal volume of the carburization reactor is usually quite large relative to the flowrates of the activating and carburizing gases, it normally takes a few minutes and sometimes even longer for essentially all of the gas inside the reactor to be replaced with the new gas being fed to the reactor. Therefore, even though the halogen-containing activating compound used for activation and the carburizing specie used for carburization are fed to the reactor separately and sequentially, nonetheless during at least some period of time in this normal operation, the gas mixture inside the reactor is composed of a mixture of the activating compound and the carburizing specie. And, because both of these ingredients are normally supplied diluted in a suitable carrier gas, the gas inside the reactor during this interim period normally contains at least three components, one or more carrier gases, the halogen-containing activating compound and the carbon-containing carburizing specie.

Thus, during conventional low temperature gas carburization, when the operating regimen of the system is being switched from an activation regimen to a carburization regimen, or from a carburization regimen back to an activation regimen, there is an interim period of time during which the workpiece may possibly come into contact with both the halogen-containing activating compound and the carburizing specie simultaneously. This incidental simultaneous contact is different from that occurring in the invention described here in that, in this invention, simultaneous contact of the workpiece with the carbon-free, halogen-containing activating compound and the unsaturated hydrocarbon carburizing specie occurs because both are being fed to the reactor concurrently, i.e., simultaneously.

Specifically, in this invention, the workpiece comes into contact inside the carburization reactor with a gas mixture which contains a predetermined and controlled concentration of carbon-free, halogen-containing activating compound, as well as a predetermined and controlled concentration of unsaturated hydrocarbon carburizing specie, for a predetermined and controlled period of time. This is different from the incidental simultaneous contact that may possibly occur in conventional low temperature gas carburization in which the duration of concurrent contact, if any, as well as the concentrations of the activating compound and carburizing specie during this simultaneous contact are unknown, undefined, transient and ephemeral.

Gas Mixture Inside the Carburization Reactor

The unsaturated hydrocarbon used for carburization in this invention ("carburizing specie") will normally be acetylene. However, in addition to or in place of acetylene, essentially any other unsaturated hydrocarbon ("acetylene analogue") can be used as the carburizing specie, including hydrocarbons with ethylenic unsaturation, hydrocarbons with acetylenic unsaturation and hydrocarbons with aromatic unsaturation. In this context, "hydrocarbon" has its ordinary meaning, i.e., a compound composed of carbon and hydrogen only, with no other element being present. For example, ethylenically unsaturated hydrocarbons including monoolefins and polyolefins, both conjugated and unconjugated, can be used. Ethene (ethylene), propene (propylene), butene, and butadiene are good examples. Acetylenically unsaturated hydrocarbons such as acetylene and propyne ($C_3H_4$) can also be used. Acetylene and $C_1$-$C_6$ ethylenically unsaturated compounds are of special interest because of low cost and ready availability. Mixtures of these compounds can also be used.

As indicated above, it has been found in accordance with this invention that low temperature gas carburization under a soft vacuum using an unsaturated hydrocarbon as the carburizing specie can be carried out faster than possible in the past by including a carbon-free halogen-containing activating compound in the carburizing gas. Accordingly, the gas mixture inside the carburization reactor in this invention will also include at least one of these compounds. Specific examples include HF, HCl, $NF_3$, $F_2$ and $Cl_2$. HCl is the activating compound of choice, because it is readily available, inexpensive and does not involve the environmental and operating problems associated with fluorine-containing gases. $Cl_2$ can also be used, but it is less reactive and hence less effective than HCl.

As explained in our earlier published application U.S. 2011/0030849 mentioned above, it is desirable when carrying out low temperature gas carburization under a soft vacuum using acetylene or analogue as the carburizing specie to include a companion gas in the gas mixture inside the carburization reactor. In this context, "companion gas" means any gas which will readily react with oxygen under the reaction conditions encountered during the carburization reaction and, in addition, which is not an unsaturated hydrocarbon. As further explained there, the function of this companion gas is to make the reducing conditions seen by the workpiece more intense than would otherwise be the case. This, together with the acetylene already in the system, eliminates formation of unwanted thermal oxide byproduct film virtually completely.

Hydrogen ($H_2$) is the preferred companion gas, since it is inexpensive and readily available. Natural gas, propane, other $C_1$-$C_6$ alkanes and other saturated hydrocarbons are also believed to be suitable for this purpose, as they readily react with oxygen at the elevated temperatures involved in low temperature carburization. On the other hand, nitrogen and the other inert gases are not suitable for this purpose, since they do not react with oxygen under these conditions. In addition, acetylene and other unsaturated hydrocarbons are not "companion gases" within the meaning of this disclosure, because they serve as the active carburizing specie.

In addition to the above ingredients, other inert or essentially inert diluent gases can be included in the gas mixture inside the carburization reactor during the inventive carburization reaction, these diluent gases typically being used as carrier gases for supplying the active ingredients to the reactor. Examples of such diluent gases include nitrogen, argon and the like. Other essentially inert diluent gases can also be used, it being desirable to avoid using compounds containing significant amounts of oxygen, nitrogen, boron and/or any other non-inert element (other than carbon and hydrogen) to avoid introducing such elements into the workpiece. For example, the saturated halogen-containing hydrocarbons described in the above-noted WO 2006/136166 (U.S. 2009/0178733) to Marcel Somers et al. can be used, as they are essentially benign in the inventive reaction system.

However, because reaction pressures are so low, there is no real economic advantage to including any such inert or essentially inert diluent gas. Accordingly, the gas inside the carburization reactor during the inventive carburization reaction will normally consist essentially of the unsaturated hydrocarbon carburizing specie of this invention, the carbon-free halogen containing activating compound of this invention and the companion gas.

Relative Proportions of Carburizing Specie and Activating Compound

The inventive low temperature gas carburization process described here is carried out using generally the same concentration of unsaturated hydrocarbon carburizing specie as describe in our earlier U.S. 2011/0030849, i.e., a partial pressure of about 0.5 to 20 torr (~67 to ~2.666 Pa). This means that the ratio of the partial pressure of companion gas to carburizing specie will normally be at least about 2, with partial pressure ratios of ≥4, ≥5, ≥7, ≥10, ≥15, ≥20, ≥25, ≥50 and even ≥100 being contemplated In terms of concentrations, this means that the concentration of carburizing specie in the gas mixture inside the carburization reactor during the inventive carburization process can approach ~66 vol. % as a maximum. Maximum concentrations on the order of 50 vol. %, 40 vol. %, 35 vol. %, 30 vol. %, or even 20 vol. %, are contemplated. The minimum concentration of carburizing specie is set by economics in the sense that enough carburizing specie needs to be included to accomplish carburization in a commercially reasonable time. Thus, the concentration of carburizing specie can be as low as 0.5 vol. %, with minimum concentrations on the order of 1 vol. %, 2 vol. %., 3 vol. %, and even 5 vol. %, being contemplated. Concentrations on the order of 3 to 50 vol. %, 4 to 45 vol. %, 7 to 40 vol. %, 8 to 35 vol. %, and even 10 to 25 vol. %, are more common.

As indicated above, it has been found in accordance with this invention that low temperature gas carburization under a soft vacuum using an unsaturated hydrocarbon as the carburizing specie can be carried out faster than possible in the past by including a carbon-free halogen-containing activating compound in the carburizing gas. In addition, it has also been found that the presence of this activating compound makes soot form faster, not only on the surfaces of the workpiece being carburized but also on the reactor internal surfaces as well. Thus, it appears that this activating compound, in some way, not only further activates the surfaces of workpiece being carburized but also makes the carburizing specie more active in terms of decomposing to yield carbon atoms.

In any event, because soot formation is promoted when an activating compound is included in the carburizing gas in accordance with this invention, it may be desirable to reduce the concentration of carburizing specie in the carburizing gas to levels less than those indicated above, at least when attempting to produce carburized products exhibiting shiny metallic surfaces essentially free of soot. Thus, to carry out the inventive process in a manner which avoids soot formation essentially completely, it may be desirable to limit the maximum concentration of carburizing specie in the carburizing gas to 25 vol. %, 20 vol. %, 15 vol. %, 12 vol. % or even 10 vol. %, while maintaining the same minimum concentrations mentioned above, i.e., 0.5 vol. %, 1 vol. %, 2 vol. %., 3 vol. %, or 5 vol. %. Accordingly, when carrying out this invention in a manner which avoids soot formation essentially completely, it is desirable to maintain the concentration of carburizing specie in the carburizing gas at concentrations on the order of 0.5 to 25 vol. %, 1 to 20 vol. %, 2 to 15 vol. %, 3 to 12 vol. %, and even 5 to 10 vol. %.

The concentration of carbon-free halogen-containing activating compound in the carburizing gas of this invention should be enough to produce a noticeable effect on the speed (rate) of the carburization reaction. Normally, this means that the concentration of activating compound will be at least about 0.1 vol. %, although minimum concentrations of 0.2 vol. %, 0.5 vol. %, 0.7 vol. % and even 0.9 vol. % are more typical. In addition, the concentration of carbon-free halogen-containing activating compound should not be so high that excessive shoot formation occurs. Thus, the concentration of activating compound will normally be no greater than 10 vol. %, although maximum concentrations of 5 vol. %, 4 vol. % to 3 vol. %, 2 vol. % to and even 1.5 vol. %, are contemplated. Thus, concentration ranges of about 0.5 vol. % to 3 vol. %, 0.7 vol. % to 2 vol. %, and 0.9 vol. % to 1.5 vol. % are more typical.

Mechanism for Feeding Ingredients to the Carburization Reactor

As indicated above, the inventive low temperature gas carburization process differs from earlier approaches in that, in the inventive process, once the initial activation of the workpiece has been completed, the unsaturated hydrocarbon carburizing specie used for carburization and the carbon-free, halogen-containing activating compound used for additional activation are fed to the carburization reactor simultaneously rather than separately and sequentially.

This simultaneous feeding of the carburizing specie and the activating compound can be accomplished in any manner which produces controlled concentrations of these ingredients inside the carburization reactor during the carburization reaction. Thus, these ingredients can be combined before being fed to the carburization reactor, or they can be fed to the carburization reactor separately for combining once inside the reactor. Moreover, in both cases, these ingredients can be diluted with suitable carrier gases before being fed to the reactor. And as further indicated above, preferably these carrier gases are "companion gases," i.e., any gas which will readily react with oxygen under the reaction conditions encountered during the carburization reaction and, in addition, which is not an unsaturated hydrocarbon. Most preferably, hydrogen is used for supplying both the carburizing specie and the activating compound, whether supplied separately or combined.

Adjusting the Time the Activating Compound is Fed to the Carburization Reactor

In accordance with this invention, it has also been found that the length of time the carbon-free, halogen-containing activating compound is fed to the carburization reactor during carburization affects soot formation. That is to say, soot does not normally begin forming in the inventive process immediately after carburization begins. Rather, for each combination of carburizing specie concentration and activating compound concentration, soot begins forming only after some finite period of time has elapsed from the start of the carburization reaction. So, in addition to adjusting the concentration of carburizing specie and the concentration of activating compound in the carburizing gas, controlling soot formation can also be done by adjusting the time during which the activating compound is included in the carburizing gas being fed to the reactor.

This is illustrated in the following working Examples 2 and 3, which show that terminating the flow of activating compound to the reactor at different times after the carburization reaction starts affects soot formation. In particular, these working examples show that for a given combination of activating compound concentration (1 vol. % HCl) and carburizing specie concentration (10 vol. % acetylene), terminating the flow of activating compound earlier (3 minutes after carburization starts) rather than later (30 minutes after carburization starts) affects how much soot is formed.

Using these and the other working examples in this disclosure as a guide, the duration of the time the carbon-free, halogen-containing activating compound should be included in the carburizing gas being fed to the reactor can easily be determined by routine experimentation. Generally speaking, this length of time will normally range between ~0.5 minute to 2 hours, ~1 minute to 1 hour, ~2 minutes to ~40 minutes, ~3 minutes to ~30 minutes or even ~4 minutes to ~20 minutes, measured from the start of the carburization reaction. However, the activating compound can be included in the carburizing gas for longer periods of time, including up to 4 hours, 6 hours, 8 hours, 10 hours, or even for the entire duration of the carburization reaction, if desired.

It should also be appreciated that the period of time for concurrent flow of activating compound and carburizing specie (i.e., the period of time during which the activating compound is being fed to the carburization reactor) need not start with the start of carburization. Rather, initiation of this period of concurrent flow can be delayed from the start of the carburization reaction by any suitable period of time such as, for example, 1, 5, 10, 15, 20, 30, 40 or 50 minutes, or even longer such as 1 hour, 2 hours, 3 hours, 4 hours, or even longer. Such a delay may be helpful in controlling soot formation.

Pulsing the Activating Compound

In accordance with yet another feature of this invention, the supply of carbon-free, halogen-containing activating compound to the reactor during the carburization reaction is pulsed. In other words, the concentration of this activating compound in the carburizing gas being fed to the reactor during the carburization step is pulsed between higher and lower values (including zero). In addition to helping control soot formation, this approach may also further speed carburization.

Pulsing the activating compound can be done in a variety of different ways. For example, the activating compound can be pulsed by repeatedly changing the flowrate of the activating compound to the reactor between higher and lower values. Moreover, the levels of these higher and lower values can be increased or decreased over time, if desired, to achieve a corresponding increase or decrease in the concentration of activating compound seen by the workpiece. In the same way, the duration of each pulse, the frequency of each pulse, or both, can be increased or decreased over time, if desired, to achieve a corresponding increase or decrease in the concentration of activating compound seen by the workpiece.

Changing the Carburization Potential

In our earlier U.S. Pat. No. 6,547,888 mentioned above, we describe a modified low temperature carburization process in which the carburization potential seen by the stainless steel workpiece is changed over the course of the carburization reaction. Provided that this change is done in an appropriate way, we found that the overall carburization reaction can be done faster, the production of soot reduced, or both, relative to conventional practice.

As described there, these changes in the carburization potential include four different approaches, namely (1) lowering the carburization temperature, (2) lower the concentration of carburizing specie in the carburizing gas, (3) interrupting the carburization process while maintaining the workpiece at elevated temperature, and (4) interrupting the carburization process as in (3) but also reactivating the workpiece during this interruption by contact with a halogen containing gas.

In accordance with another feature of this invention, the inventive low temperature carburization processes described here is used in combination with the technology described in our earlier U.S. Pat. No. 6,547,888 to provide especially fast low temperature gas carburization. This can be done by including the carbon-free, halogen-containing activating compound of this invention in the carburization gas used in any of the particular approaches for changing carburization potential described there.

WORKING EXAMPLES

In order to describe this invention more thoroughly, the following working examples are provided.

Example 1

An AISI 316 stainless steel workpiece, after cleaning to remove organic residue, was placed in a carburizing reactor having an internal volume of 3.75 cubic feet (~106 liters), which was then evacuated to a hydrogen pressure of 8 torr, while the internal temperature of the reactor was raised to 450° C. 14 liter/min. of a carburizing gas comprising 30 vol. % acetylene, 1 vol. % HCl, balance hydrogen ($H_2$) was then fed to the reactor, while maintaining the internal temperature of the reactor 450° C. and the internal pressure of the reactor at 8 torr.

These conditions were maintained essentially constant for 2 hours, at which time the makeup of the carburizing gas being fed to the reactor was changed to be 10 vol. % acetylene, balance hydrogen ($H_2$). Carburization was continued under these conditions for an additional 13 hours (total carburization time of 15 hours), at which time the flow of acetylene to the carburization reactor was terminated while the flow rate of hydrogen was continued at 8 torr pressure until the workpiece had cooled to about room temperature.

After removal from the reactor, the workpiece so obtained was examined and found to have achieved a carbon diffusion depth of about 25 microns with surface concentration greater than 40 atom %, with a case hardness of 900 Hv at 6 micron depth, 600 Hv at 10 micron depth, core at 300 Hv. Visual inspection revealed that the workpiece as well as the reactor internal were covered with significant amounts of soot, but no significant amount of thermal oxide was apparent on the workpiece surfaces.

Comparative Example A

Example 1 was repeated, except no HCl was included in the carburizing gas. The workpiece was found to have achieved a carbon diffusion depth of about 15 microns with surface concentration of about 8 atom %, with a case hardness of 600 Hv at 6 micron depth, 400 Hv at 10 micron depth, core at 300 Hv. Visual inspection revealed that the workpiece as well as the reactor internal were covered with significant amounts of soot, but no significant amount of thermal oxide was apparent on the workpiece surfaces.

Together, Example 1 and Comparative Example A show that including a small amount of HCl in the carburizing gas achieves a substantial increase in the amount of carburization that occurs under a given set of carburization conditions. This, in turn, means including HCl in the carburization gas being fed to the reactor significantly enhances the rate of the overall carburization reaction. In addition, both examples show that conventional activation such as by contact with HCl can be dispensed with if the particular carburization conditions used are severe in terms of carburization potential. However, the amount of by-product soot produced is substantial when these severe carburization conditions are used, which may not be appropriate for commercial operations.

Example 2

An AISI 316 stainless steel workpiece, after cleaning to remove organic residue, was placed in a carburizing reactor having an internal volume of 3.75 cubic feet (~106 liters) which was then evacuated to a hydrogen pressure of 6 torr, while the internal temperature of the reactor was raised to 450° C. The workpiece was then activated by continuously feeding an activating gas comprising 1 vol. % HCl gas in $H_2$ to the reactor at a flow rate of about 5 liter/min. while maintaining the internal temperature of the reactor at 450° C. and the internal pressure of the reactor at 6 torr.

The carburizing procedure of Example 1 was repeated, except that total system pressure during the entire carburization reaction was 6 torr, the concentration of acetylene in the carburization gas during the entire carburization reaction was 10 vol. %, and the flow of HCl to the carburization reactor (i.e., the time period during which HCl was included in the carburizing gas being fed to the reactor) was terminated 3 minutes after carburization started. The workpiece was found to have achieved a carbon diffusion depth of about 20 microns with a surface concentration of about 10 atom % and a case hardness of 800 Hv at 5 microns depth. Visual inspection revealed that the workpiece exhibited a bright, shiny metallic surface essentially free of the surface adherent soot and thermal oxide coating that normally forms as a result of low temperature carburization, thereby eliminating the need for any post processing cleaning.

Example 3

Example 2 was repeated, except that the period of concurrent flow of HCl to the carburization reactor (i.e., the time period during which HCl was included in the carburizing gas being fed tot the reactor) was terminated 30 minutes after carburization started. The workpiece was found to have achieved a carbon diffusion depth of about 30 microns, with a surface concentration of about 40 atom % and a case hardness of 850 Hv at 7 microns depth. Visual inspection revealed that the workpiece exhibited surface finish almost as bright, shiny and soot free as that of the workpiece produced in Example 2, except that some patchy darkened zones were apparent on the workpiece surfaces.

Together, Examples 2 and 3 show that the inventive low temperature gas carburization process can be carried out in a manner which avoids formation of soot and thermal oxide, thereby eliminating the need for post processing cleaning, by suitable selection of the concentration of the activating compound included in the carburizing gas as well as the length of time this activating compound is included in the carburizing gas. Meanwhile, comparison of Examples 2 and 3 shows that the period of concurrent flow of activating compound and carburizing gas (i.e., the period of time during which the activating compound is included in the carburizing gas being fed to the carburization reactor), by itself, is an effective variable in controlling formation of soot and yellowish thermal oxide coating when practicing the technology of this invention.

Although only a few embodiments of the present invention have been described above, it should be appreciated that many modifications can be made without departing from the spirit and scope of the invention. All such modifications are intended to be included within the scope of the present invention, which is to be limited only by the following claims.

The invention claimed is:

1. A process for surface hardening a workpiece made from an iron, nickel and/or chromium based alloy by gas carburization in which an unsaturated hydrocarbon is contacted with the workpiece inside a carburization reactor under a pressure of about 3.5 to 100 torr and at an elevated carburization temperature to cause carbon to diffuse into the workplace surfaces thereby forming a hardened primary surface layer which is essentially free of carbide precipitates as well as a thermal oxide film, the process further comprising increasing the rate at which carburization occurs by feeding a carbon-free, halogen-containing activating compound to the carburization reactor simultaneously with feeding the unsaturated hydrocarbon to the carburization reactor, wherein the hydrocarbon inside the carburization reactor is about 8 to 35 vol. %, the concentration of the carbon-free, halogen-containing activating compound inside the carburization reactor is about 0.5 vol. % to 3 vol. % and the flow of carbon-free, halogen-containing activating compound being fed to the carburization reactor during carburization is pulsed.

2. The process of claim 1, wherein the carbon-free, halogen-containing activating compound is HF, HCl, $NF_3$, $F_2$, $Cl_2$ or a mixture thereof.

3. The process of claim 2, wherein the workpiece is made from stainless steel and further wherein, prior to contact of the workpiece with the unsaturated hydrocarbon, the workpiece is not activated to remove the coherent, impervious layer of chromium oxide which forms on the surface of the stainless steel.

4. The process of claim 3, wherein the stainless steel is made from an AISI 300 or 400 series.

5. The process of claim 4, further comprising feeding a companion gas to the carburization reactor, the companion gas being a gas which is not an unsaturated hydrocarbon and further which is capable of reacting with oxygen under the conditions encountered during the carburization reaction.

6. The process of claim 5, wherein the companion gas is hydrogen.

7. The process of claim 3, wherein the carburization potential of the gas mixture inside the carburization reactor is changed over the course of carburization by at least one of (1) lowering the carburization temperature, (2) lowering the concentration of unsaturated hydrocarbon in the carburizing gas, (3) interrupting the carburization process by terminating the flow of unsaturated hydrocarbon to the carburization reactor while maintaining the workpiece at elevated temperature, and (4) interrupting the carburization process by terminating the flow of unsaturated hydrocarbon to the carburization reactor while maintaining the workpiece at elevated temperature and, during this interruption, reactivating the workpiece by contact with a carbon-free, halogen containing gas.

8. The process of claim 2, comprising (a) contacting the workpiece inside a carburization reactor with a halogen-containing activating compound to at least partially activate the workpiece for low temperature carburization, (b) thereafter feeding an unsaturated hydrocarbon to the carburization reactor under a pressure of about 3.5 to 100 torr and at an elevated carburization temperature to cause carbon to diffuse into the workpiece surfaces thereby forming a hardened primary surface layer which is essentially free of carbide precipitates as well as an undesirable thermal oxide film, and (c) simultaneously with step (b) feeding additional amounts of a halogen containing activating compound to the carburization reactor for about 0.5 minutes to about 2 hours, after which the feeding of this carbon-free, halogen-containing activating compound to the carburization reactor is terminated while the feeding of the unsaturated hydrocarbon to the carburization reactor is continued.

9. The process of claim 8, wherein steps (b) and (c) start at the same time.

10. The process of claim 8, wherein additional amounts of a halogen containing activating compound are fed to the carburization reactor in step (c) for about 1 minute to about 1 hour.

11. The process of claim 10, wherein additional amounts of a halogen containing activating compound are fed to the carburization reactor in step (c) for ~2 minutes to ~40 minutes.

12. The process of claim 8, wherein the feeding of additional amounts of halogen containing activating compound to the carburization reactor in step (c) is terminated early enough to avoid formation of by-product soot.

13. The process of claim 8, wherein the carburization potential of the gas mixture inside the carburization reactor is changed over the course of carburization by at least one of (1) lowering the carburization temperature, (2) lowering the concentration of unsaturated hydrocarbon in the carburizing gas, (3) interrupting the carburization process by terminating the flow of unsaturated hydrocarbon to the carburization reactor while maintaining the workpiece at elevated temperature, and (4) interrupting the carburization process by terminating the flow of unsaturated hydrocarbon to the carburization reactor while maintaining the workpiece at elevated temperature and, during this interruption, reactivating the workpiece by contact with a carbon-free, halogen containing gas.

* * * * *